US005462071A

United States Patent [19]

Heitmann

[11] Patent Number: 5,462,071

[45] Date of Patent: Oct. 31, 1995

[54] COOLING SYSTEM FOR PRODUCTION UNITS IN PLANTS OF THE TOBACCO PROCESSING INDUSTRY

[75] Inventor: Uwe Heitmann, Hamburg, Germany

[73] Assignee: Hauni Maschinenbau AG, Hamburg, Germany

[21] Appl. No.: 113,401

[22] Filed: Aug. 27, 1993

[30] Foreign Application Priority Data

Aug. 28, 1992 [DE] Germany ..... 42 28 607.7

[51] Int. Cl.[6] ..... A24C 5/00

[52] U.S. Cl. ..... 131/280; 62/208

[58] Field of Search ..... 131/84.1–84.4, 131/280, 290; 62/404, 407, 79, 203, 207, 208

[56] References Cited

U.S. PATENT DOCUMENTS 3,529,439 9/1970 Brennan ..... 62/407
4,284,236 8/1981 Bradshaw .
4,386,733 6/1983 Bradshaw .
4,949,547 8/1990 Shimizu ..... 62/79
5,265,442 11/1993 Lamie ..... 62/407 X

*Primary Examiner*—Jennifer Bahr
*Attorney, Agent, or Firm*—Darby & Darby

[57] ABSTRACT

Various machines of a production line in a plant of the tobacco processing industry are installed in an air conditioned enclosure. In order to prevent the heat which is generated and dissipated by selected components of such machines from affecting the conditioned air in the enclosure, the production line is associated with a cooling system which withdraws and/or otherwise receives heat from the selected components and includes a portion outside of the enclosure. The cooling system operates with a fluid coolant which conveys heat from the heat generating and dissipating components and out of the enclosure to be cooled in the portion outside of the enclosure prior to being reintroduced into the enclosure to again withdraw heat from the selected components. This ensures that the air conditioning system for the enclosure is not affected or is not unduly affected by heat which is being generated and dissipated by the selected components of the machines in the enclosure.

16 Claims, 4 Drawing Sheets

COOLING SYSTEM FOR PRODUCTION UNITS IN PLANTS OF THE TOBACCO PROCESSING INDUSTRY

BACKGROUND OF THE INVENTION

The invention relates to improvements in plants for the making of commodities which contain tobacco and/or are used in conjunction with tobacco containing products. More particularly, the invention relates to improvements in plants for the making of plain or filter cigarettes, cigars or cigarillos, filter rod sections and/or other commodities which are turned out by the tobacco processing industry. Still more particularly, the invention relates to improvements in means for preventing overheating of certain components of or entire units which are used to produce and/or process various commodities in the plants of the tobacco processing industry.

It is often necessary to employ an air conditioned enclosure (e.g., a building or a portion of a building) in a plant which is used for the making of rod-shaped and/or other products of the tobacco processing industry. For example, it is often necessary to install a production line including one or more units such as cigarette makers, filter tipping machines, packing machines, cellophaning machines, carton filling machines and carton baling machines in an air conditioned hall in order to ensure that the temperature, the moisture content and/or other characteristics of conditioned air will remain within an optimum range. On the other hand, at least some such units include components, subassemblies or aggregates which generate substantial amounts of heat. The heat must be removed in order to avoid overheating of tobacco particles and/or other constituents of commodities which are being turned out in the plants of the tobacco processing industry. The heat generating components, subassemblies or aggregates of production units can constitute fans, blowers, motors, switch cabinets, conveyors, transmissions, housings, casings and/or others.

If a component which generates substantial amounts of heat, while the respective production unit is in actual use, is permitted to dissipate heat directly into the air conditioned enclosure for such unit, the air conditioning system must be adjusted continuously or at frequent intervals, either automatically or by hand, and the energy losses are very pronounced. The situation is aggravated if the plant contains modern high-speed production units which can turn out inordinately large numbers of tobacco products per unit of time. For example, a modern cigarette maker can turn out well in excess of 10,000 cigarettes per minute. The commodities, subassemblies and/or other aggregates which generate substantial amounts of heat when a production line containing one or more high-speed machines is in actual use can be cooled only with the expenditure of large amounts of energy because such cooling involves withdrawal of heat from the interior of the enclosure which contains the production unit or units in question. As a rule, the enclosure will contain a large number of production units each of which includes at least one heat generating component, subassembly or aggregate.

OBJECTS OF THE INVENTION

An object of the invention is to provide a plant for the making of products of the tobacco processing industry wherein the cooling of heat generating units and/or their components can be achieved in a simple and inexpensive way.

Another object of the invention is to provide a novel and improved cooling system for use in the plants of the tobacco processing industry.

A further object of the invention is to provide a novel and improved method of cooling selected units and/or components of a production line for the making of plain or filter cigarettes, cigars, cigarillos, filter rod sections, packets which contain smokers' products, cartons which contain such packets and/or boxes or bales which contain such cartons.

An additional object of the invention is to provide a cigarette rod making or like machine, a filter rod making or like machine, a filter tipping or like machine, a packing or like machine, a carton filling or like machine, a cellophaning machine for packets of cigarettes or the like and/or a machine for the baling or crating of cartons of cigarette packets or the like with novel and improved means for effectively and economically cooling their conveyors, motors, chambers, casings, housings, fans, blowers, and/or other heat generating and dissipating components without affecting the air conditioning system for the enclosure or enclosures containing such machine or machines.

Still another object of the invention is to provide a cooling system which can be installed in existing plants for the mass production of rod-shaped and/or other articles of the tobacco processing industry.

A further object of the invention is to provide a cooling system which can be designed to effectively remove heat from one or more components in one or more units for the mass production of plain or filter cigarettes, cigars, cigarillos, filter rod sections, packets for rod-shaped articles of the tobacco processing industry and/or accumulations of packets in a plant wherein such commodities are turned out in large quantities per unit of time.

Another object of the invention is to establish an optimal relationship between the air conditioning and cooling systems in the plants for the mass production of cigarettes and/or other commodities of the tobacco processing industry.

An additional object of the invention is to reduce the cost of air conditioning of plants for the production of cigarettes and/or other tobacco-containing products.

Still another object of the invention is to provide a cooling system which is simple, compact and inexpensive and can be used, with minor modifications, to remove heat from any one of a plurality of widely different components of a particular production unit or of any one of two or more different production units.

SUMMARY OF THE INVENTION

The invention is embodied in a plant or facility for the making of cigarettes, cigars, cigarillos, filter rod sections and/or other products or commodities of the tobacco processing industry. The improved plant comprises at least one enclosure (e.g., a building or a section or portion of a building), means for conditioning the at least one enclosure, and at least one heat generating production unit in the at least one enclosure. Such unit can constitute or include at least one cigarette rod making machine, at least one filter tipping machine, at least one filter rod making machine, at least one cellophaning machine, at least one carton filling machine, at least one carton bundling or crating machine, at least one packing machine or any other machine or machines which is or are utilized in the tobacco processing industry for the mass production and/or processing of commodities which constitute or form part of products turned out by the tobacco processing industry. The improved plant further comprises means for cooling the at least one heat generating production unit, and such cooling means includes a portion located outside of the at least one enclosure.

In accordance with a presently preferred embodiment, the cooling means comprised a supply of fluid coolant (e.g., a liquid coolant which can contain or constitute water), and means for conveying the coolant along at least one predetermined path having a first section at (e.g., within or adjacent) the at least one unit and a second section within the aforementioned portion of the cooling means, i.e., outside of the at least one enclosure. Such portion of the cooling means can comprise means or exchanging heat with the coolant in the second section of the at least one path; the heat exchanging means can include means for withdrawing heat from the coolant. The at least one path can constitute an endless path.

The at least one heat generating production unit can comprise (and often or normally comprises) a plurality of components including at least one heat generating component, and the at least one first section of the at least one path is at least close to the at least one heat generating component so that the coolant which is being conveyed in the at least one first section of the at least one path can withdraw heat which is generated by the at least one component.

The improved plant can comprise a plurality of heat generating production units in the at least one enclosure. The cooling means then preferably comprises at least one supply of fluid coolant and means for conveying the coolant along at least one predetermined path having first sections each of which is at least closely adjacent to a different unit so that the coolant which is conveyed in the first sections can withdraw heat from the respective units. Such at least one path further includes a second section within the aforementioned portion of the cooling means. As already mentioned above, the at least one path is or can be an endless path.

As a rule, the at least one heat generating production unit in the at least one enclosure has a predetermined power requirement and, if such unit comprises a plurality of components including at least one heat generating component, the power requirement of such at least one component is preferably not less than 50 percent and often at least close to two thirds of the predetermined power requirement.

The at least one unit can include an at least substantially sealed chamber, and the cooling means can include means for maintaining the temperature in the chamber within a selected range, e.g., below a preselected upper threshold value.

Alternatively, or in addition to such chamber, the at least one unit can comprise at least one transmission and a supply of lubricant (e.g., oil) for the transmission. The cooling means of such plant can comprise means for maintaining the temperature of the supply of lubricant within a selected temperature range.

Still further, or in addition to a chamber and/or at least one transmission, the at least one unit can comprise an air blower having a conduit for compressed air; such conduit can form part of the cooling means.

If the at least one unit comprises means for producing at least one rod of fibrous material (e.g., a continuous cigarette rod) and heat generating means for draping the at least one rod into a web of suitable wrapping material (such as cigarette paper, tipping paper or the like), the cooling means can include means for withdrawing heat from the draping means.

The at least one unit can also comprise at least one motor having a heatable housing, and the cooling means can comprise means for withdrawing heat from such housing.

If the at least one unit comprises at least one conveyor and a heatable casing for the at least one conveyor, the cooling means can comprise means for withdrawing heat from the casing.

The novel features which are considered as characteristic of the invention are set forth in particular in the appended claims. The improved plant itself, however, both as to its construction and the mode of cooling its production unit or units, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
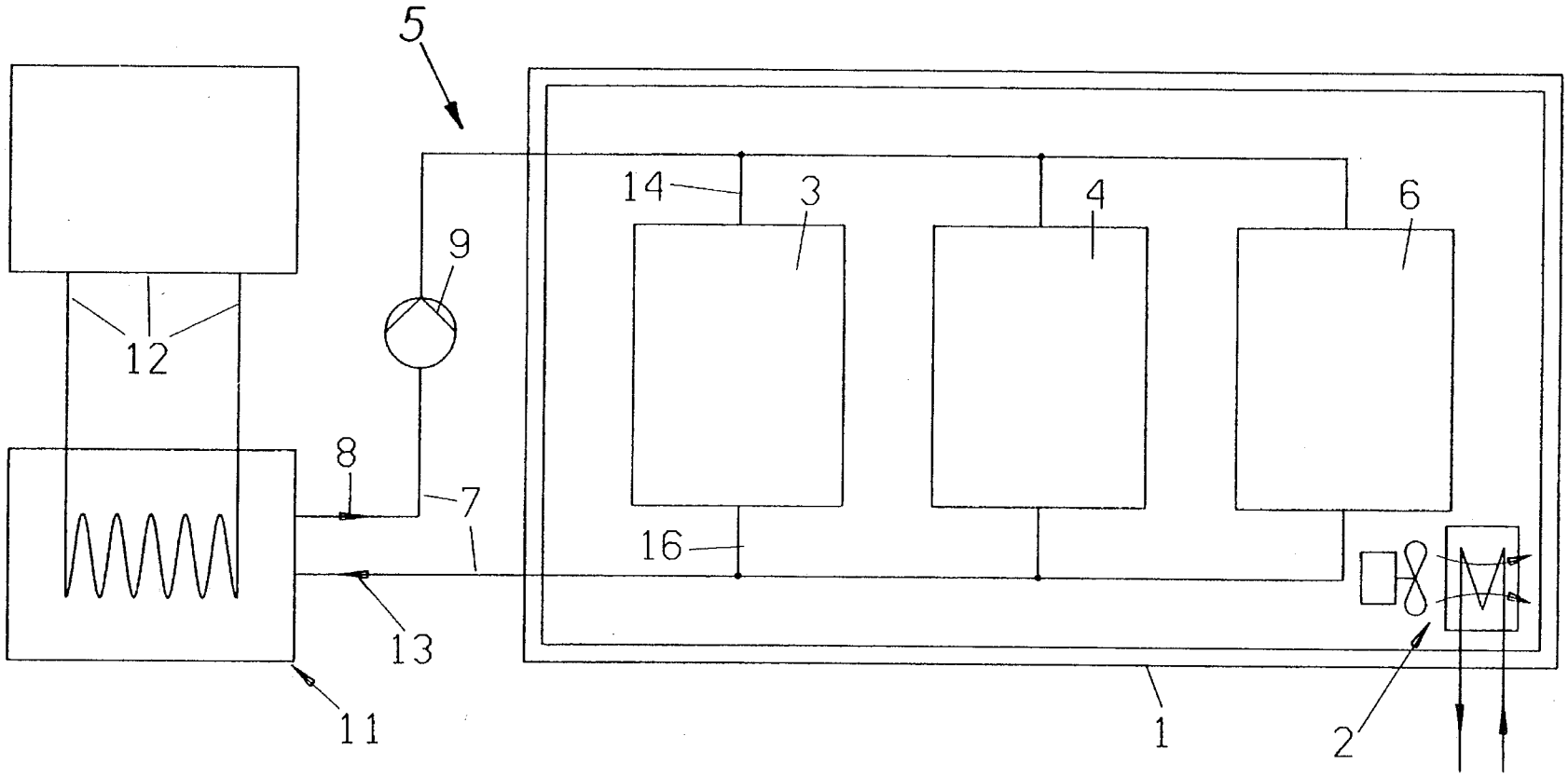
FIG. 1 is a diagrammatic plan view of a cigarette making plant with three production units in a common enclosure and a common cooling system for selected components of the three production units.

Referring first to FIG. 1, there is shown a plant which is designed for the production of rod-shaped commodities in the form of filter cigarettes, cigars or cigarillos (hereinafter referred to as cigarettes). The plant includes an at least partially closed and/or sealed enclosure 1 (e.g., a hall). The temperature and humidity of air within the enclosure 1 are maintained within preselected ranges (e.g., at a temperature of 20° C. and at a humidity of 60 percent) by an air conditioning system 2 the exact design of which forms no part of the present invention. All that counts is to ensure that certain parameters of air in the enclosure 1 be maintained within predetermined ranges which are best suited for the making of satisfactory cigarettes.

The enclosure 1 confines three production units or lines 3, 4 and 6 which may but need not be of identical design. As will be described in greater detail with reference to FIGS. 2, 3 and 4 to 8, each of the units 3, 4 and 6 can constitute a complete production line having a cigarette making machine 17 (FIGS. 2 and 3) which can be of the type known as PROTOS (made and distributed by the assignee of the present application), and a filter tipping machine 18 (FIGS. 2 and 3) which receives plain cigarettes from the machine 17 and filter rod sections from a filter rod making machine (not shown) of any known design. The filter tipping machine 18 can be of the type known as MAX (made and distributed by the assignee of the present application). The machine 18 delivers filter cigarettes to a tray filling apparatus 19 (FIG. 2) which gathers filter cigarettes into trays and constitutes a reservoir for a fluctuating supply of filter cigarettes between the tipping machine 18 and a packing machine 23. The trays which are filled with filter cigarettes in the machine 19 are emptied by an evacuating apparatus 21 (FIG. 2) which delivers the filter cigarettes to or forms part of a conveyor 22 (FIG. 2) serving to transport a mass flow of parallel filter cigarettes to the magazine of the packing machine 23. The apparatus 19 can be installed in or it can form part of the mass flow conveyor 22. The machine 23 assembles arrays of filter cigarettes into discrete packets (e.g., each such packet can constitute a so-called soft pack and can contain twenty filter cigarettes in the so-called quincunx formation) which are transported to a cellophaning machine 24 (FIG. 2) serving to confine each packet in a transparent outer envelope consisting of plastic material and normally embodying a customary tear strip to facilitate access to the flap or flaps forming part of the respective packet and being removable or openable to enable the purchaser of a packet to remove filter cigarettes. The cellophaning machine 24 delivers cellophane-wrapped packets to a carton filling machine 26 (FIG. 2) which assembles predetermined numbers of packets in cartons, and such cartons are thereupon introduced into boxes or crates in a conventional manner not forming part of the present invention. Except when specifically pointed out, the details of the machines and apparatus 17, 18, 19, 21, 22, 23, 24 and 26 form no part of the present invention. Such machines and apparatus can be identical with those in conventional production lines which are to be equipped or associated with the novel and improved cooling system 5 for certain components, subassemblies or aggregates of the production units or lines 3, 4 and 6.

The cooling system 5 includes a first portion which is installed in the enclosure 1 and is designed to withdraw heat from selected components of the units 3, 4 and 6, and a second portion which is located outside of the enclosure 1 and includes recooling means (shown in FIG. 1, as at 12) serving to exchange heat with (namely to withdraw heat from) a supply of fluid coolant (preferably water or a liquid which contains water) which is being conveyed along at least one path by a pump 9 forming part of the second portion outside of the enclosure 1. The path, preferably an endless path, is defined by a system of conduits 7 wherein the coolant flows in directions indicated by arrows 8 (from the second portion into the first portion of the cooling system 5) and 13 (from the first portion into the second portion). The conduits 14 of FIG. 1 serve to convey recooled coolant at least close to one or more selected components of each of the units 3, 4 and 6, and the conduits 16 serve to receive coolant which has been heated as a result of direct or indirect exchange of heat within the component or components in the respective production units. The second portion of the cooling system 5 comprises a heat exchanger 11 wherein the fluid entering in the direction of arrow 13 exchanges heat with a second fluid, and the second fluid is recooled in the part 12 of the second portion of the cooling system 5.

The feature that heat which is generated by one or more components of the unit 3, 4 and/or 6 is removed from the coolant at 11 ensures that the operation of the air conditioning system 2 is not affected, or is not unduly affected, by heat which must be withdrawn from the unit 3, 4 and/or 6 in order to avoid overheating of tobacco particles, other constituents of tobacco products and/or components of the respective units. It has been found that such mode of cooling at least some components of the units 3, 4, 6 reduces the energy requirements of the plant including the units 3, 4, 6, the enclosure 1 and the air conditioning system 2. Moreover, it is much simpler to maintain the temperature and the humidity of air in the enclosure 1 within predetermined optimum ranges, not only for shorter but also for long or very long periods of time.

Figure 2:
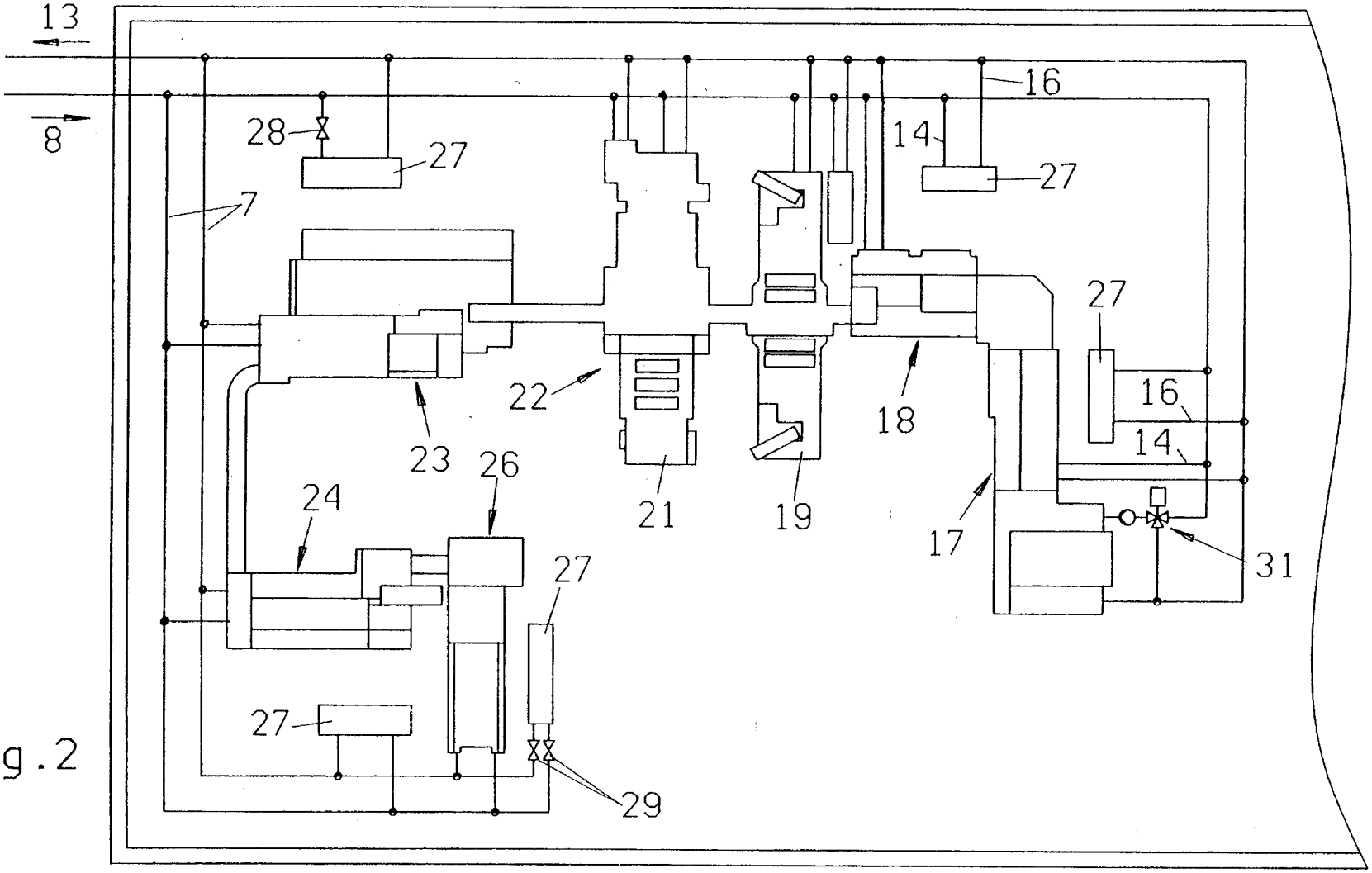
FIG. 2 illustrates certain details of one of the production units and the corresponding part of the cooling system.

FIG. 2 further shows a plurality of cabinets 27 which contain switches and/or other electrical and/or electronic devices forming part of controls for the various machines and apparatus in the production unit 3, 4 or 6. Each cabinet 27 can be said to constitute a heat generating component and, therefore, the cooling system 5 comprises or can comprise numerous discrete pairs of conduits 14, 16 serving to convey regenerated (cooled) coolant to and to convey spent (heated) coolant from the cabinets 27. The cooling system 5 further comprises suitably distributed and designed throttle valves 28, shutoff valves 29, temperature regulators 31 for regenerated coolant which is being conveyed into or close to selected components of the various machines forming part of the production line 3, 4 or 6 as well as (if necessary) one or more additional controlling and/or regulating devices which are not specifically shown in the drawing. Such additional devices can include temperature monitoring sensors in the flows of regenerated and/or heated coolant and/or temperature monitoring sensors which are applied directly to or placed adjacent the heat generating and dissipating components of various machines and apparatus (17, 18, 19, etc.) of a production unit 3, 4 or 6, one or more bypasses for regenerated and/or heated coolant, one or more thermostatically controlled valves, one or more coolant flow monitoring devices and/or others.

Figure 3:
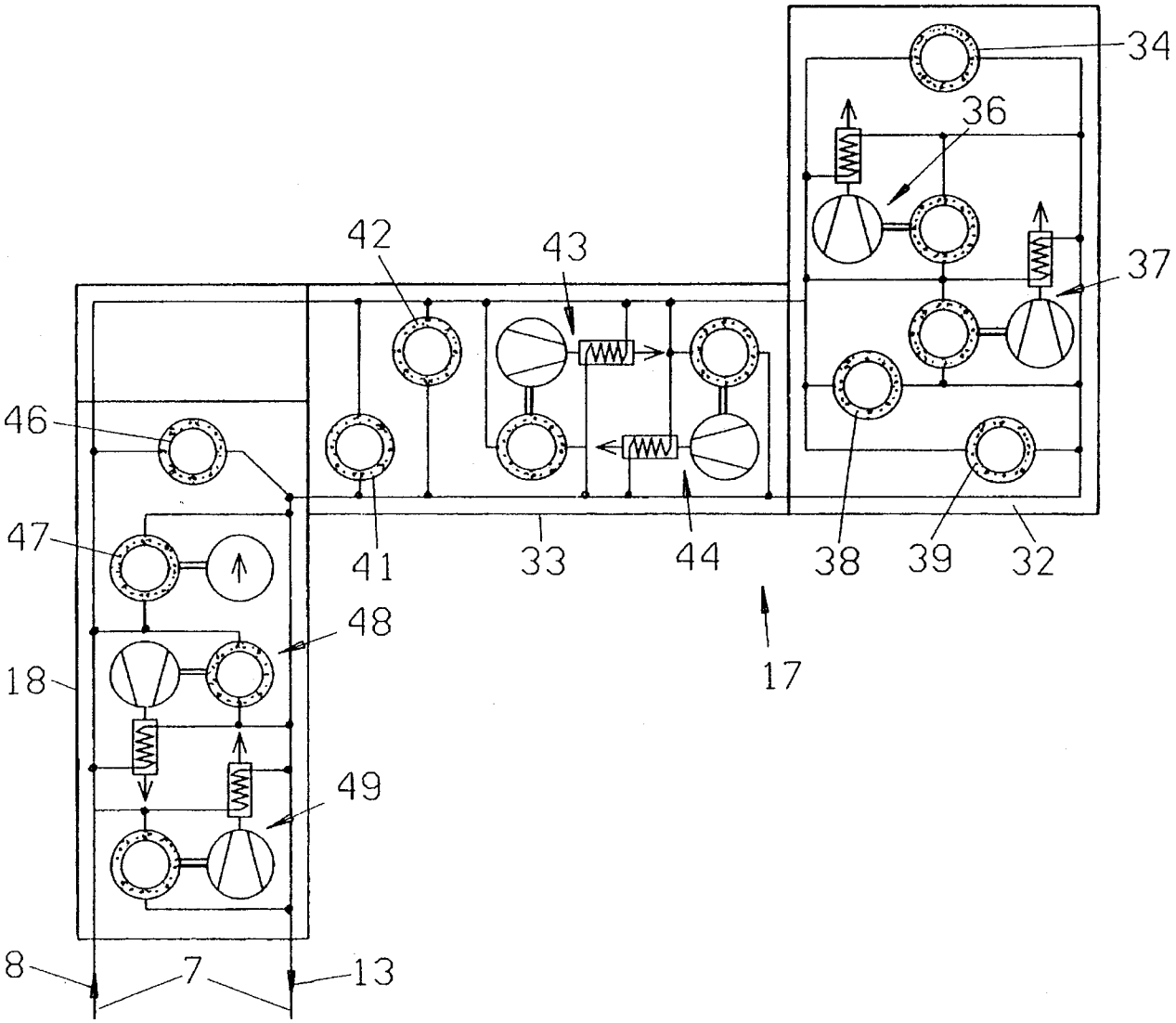
FIG. 3 illustrates additional details of the production unit which is shown in FIG. 2.

FIG. 3 illustrates various additional details of certain machines (17 and 18) forming part of a production unit 3, 4 or 6. The cigarette making machine 17 comprises a standard distributor 32 (also called hopper) and a rod making assembly 33 which converts a layer of uniformly distributed tobacco particles into one or more rod-like fillers 56 (see FIG. 7) and drapes each filler into a web of cigarette paper or other suitable wrapping material. The resulting cigarette rod or rods is or are subdivided by one or more so-called cutoffs (not specifically shown) to yield one or more files of discrete plain cigarettes of unit length or multiple unit length, and such plain cigarettes are admitted into the filter tipping machine 18.

The distributor 32 comprises a drive 34 (e.g., an electric motor or another suitable prime mover) for a so-called elevator conveyor which transports particles of comminuted tobacco leaves from a magazine to a so-called gathering duct (e.g., in a manner as described and shown in commonly owned U.S. Pat. No. 4,185,644 granted Jan. 29, 1980, to Heitmann et al. for "Distributor for cigarette makers and the like" and/or in commonly owned U.S. Pat. No. 5,009,238 granted Apr. 23, 1991 to Heitmann for "Apparatus for supplying fibrous material to machines for simultaneously producing a plurality of cigarette rods"). The distributor 32 further comprises a blower 36 which generates one or more jets or streams of compressed air, e.g., to facilitate classification of tobacco particles according to their size and/or weight, a suction generating device 37 (e.g., a fan) which draws air from a suction chamber serving to cause tobacco particles to adhere to a foraminous belt conveyor, a trimming or equalizing device 38 which brushes off or otherwise removes surplus particles from a flow of such particles (e.g., on the elevator conveyor), and a drive 39 (e.g., a variable-speed electric motor or a transmission) for the aforementioned foraminous belt conveyor.

The rod making assembly 33 of the cigarette making machine 17 comprises a drive 41 (e.g., a variable-speed motor) for the so-called garniture (a belt serving to advance a rod-like tobacco filler 56 through a wrapping mechanism), a drive 42 for a cutoff, a first blower 43 and a second blower 44.

The filter tipping machine 18 includes a main prime mover 46, a lubricant circulating pump 47 (e.g., an oil pump), a suction generating device 48 and a blower 49.

The rod making assembly 33 of the cigarette making machine 17 shown in FIG. 3 can be of the type disclosed in commonly owned U.S. Pat. No. 5,060,665 granted Oct. 29, 1991 to Heitmann for "Wrapping mechanism for making machines of the tobacco processing industry" or of the type disclosed in commonly owned U.S. Pat. No. 5,072,742 granted Dec. 17, 1991 to Heitmann for "Method of and apparatus for making a filler of smokable material". The filter tipping machine 18 of FIGS. 2 and 3 can be of the type disclosed in commonly owned U.S. Pat. No. 4,969,551 granted Nov. 13, 1990 to Heitmann et al. for "Method of and apparatus for rolling rod-shaped articles". This patent further describes a machine which can be used to deliver filter rod sections to the filter tipping machine 18 of FIGS. 2 and 3. The disclosures of all patents which are enumerated in the present specification are incorporated herein by reference.

The power requirements of the component 34, 36, 37, 38 and/or 39 can exceed one-third of the overall power requirements of the distributor 32, and the power requirements of the component 41, 42, 43 and/or 44 can exceed one-third of the total power requirements of the rod making assembly 33 in the cigarette making machine. Analogously, the power requirements of the main prime mover 46, pump 47, suction generating device 48 and/or blower 49 can exceed one-third of the overall power requirements of the filter tipping machine 18.

Figure 4:
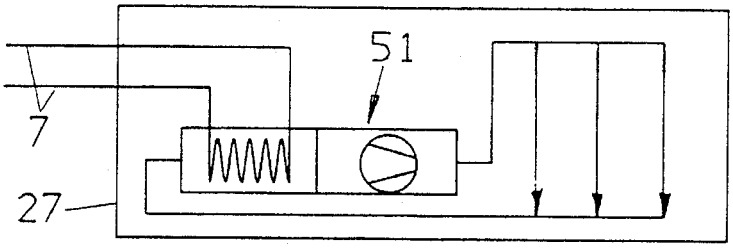
FIG. 4 is a diagrammatic view of a switch cabinet in the production unit of FIGS. 2 and 3 and of the corresponding part of the cooling system.

FIG. 4 shows schematically an air circulating arrangement 51 which is installed in a cabinet 27 and can be connected with the cooling system 5 so that the coolant which is circulated or conveyed by the pump 9 of FIG. 1 can withdraw excess heat when the unit 3, 4 or 6 embodying or cooperating with the cabinet 27 of FIG. 4 is in actual use. The air circulating system 51 is installed in or serves to circulate air in an at least substantially sealed or closed chamber, casing or housing of the cabinet 27.

Figure 5:
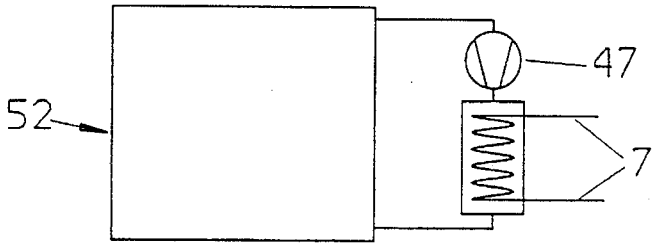
FIG. 5 is a similar diagrammatic view of a transmission in the production unit of FIGS. 2–3 and of the corresponding part of the cooling system.

FIG. 5 shows the manner in which the pump 47 serving to circulate lubricant (e.g., oil) for a transmission 52 is associated with the cooling system 5 so that the latter can withdraw a certain amount of generated heat and such heat is transferred to the heat exchange fluid which is cooled in the recooling means 12 forming part of the second portion of the cooling system, i.e., of the portion which is not confined in the enclosure 1.

Figure 6:
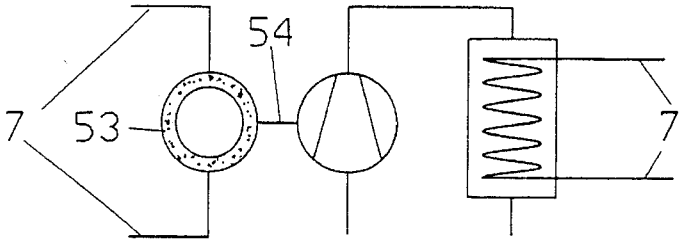
FIG. 6 is a similar diagrammatic view of a blower in the unit of FIGS. 2–3 and of the corresponding part of the cooling system.

FIG. 6 illustrates the manner in which a blower (such as the blower 36 in the distributor 32 of FIG. 3) can be cooled by fluid coolant circulating or flowing along a predetermined path under the action of the pump 9. The blower 36 comprises a motor 53 and a outlet 54 (e.g., a conduit) for compressed air. The conduit 54 can be said to form part of the cooling system 5. The conduits 7 of the system 5 including the structure of FIG. 6 include separate portions connected with the motor 53 and conduit 54, respectively.

Figure 7:
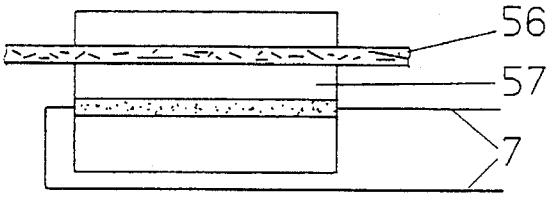
FIG. 7 is a similar view of a wrapping mechanism for a tobacco rod and of the corresponding part of the cooling system.

FIG. 7 shows a continuous rod-like filler 56 which can contain natural, synthetic and/or reconstituted tobacco, and a wrapping mechanism 57 (also called format) which is designed to confine the filler 56 in a wrapper of cigarette paper or the like. The mechanism 57 exchanges heat with fluid coolant which is conveyed in the conduits 7 of the cooling system 5.

Figure 8:
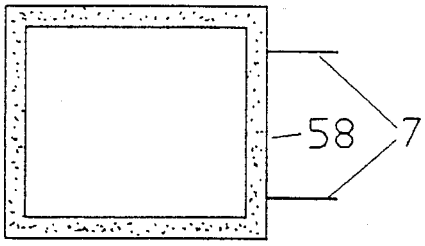
FIG. 8 is a similar view of a casing for a conveyor and of the corresponding part of the cooling system.

FIG. 8 shows a housing or casing 58 which can confine a rotary blower wheel or another conveyor (not specifically shown) and is cooled by the fluid flowing in the conduits 7 of the cooling system 5.

All embodiments of the improved plant exhibit the advantage that the enclosure 1 is conditioned and that at least some components of the units 3, 4, 6 are cooled with considerable savings in energy because heat which is being generated and dissipated by one or more components of each of these units need not influence the condition of air in the enclosure 1. This is due to the fact that the fluid coolant of the cooling system 5 conveys such heat to the second portion of the system 5 and the coolant flowing in the direction of arrows 8 is again ready to exchange heat with selected components of the unit 3, 4 and/or 6. The path for the flow of coolant may but need not be an endless path, as long as the withdrawal of heat from the units 3, 4, 6 can take place without unduly affecting the characteristics of air in the enclosure 1.

Another important advantage of the improved plant and of its cooling system 5 is that the withdrawal of heat from the units 3, 4, 6 can be regulated independently of the air conditioning system 2 and/or vice versa. This contributes to simplicity of the controls for the air conditioner and for the cooling unit and renders it possible to maintain the air in the enclosure 1 at a selected temperature and moisture content for extended periods of time with a minimum of regulation.

The cooling system 5 need not be connected with each and every component of the unit 3, 4 and/or 6, as long as it is capable of withdrawing heat from certain components which, in the absence of cooling, could unduly affect the temperature and/or humidity of air in the enclosure 1, the characteristics of commodities which are being turned out by the units 3, 4 and 6 and/or the useful life and/or mode of operation of such units. Though it is possible to provide a discrete cooling system 5 (or an analogous cooling system) for each production unit, it is presently preferred to employ a cooling system which is common to all of the production units in the enclosure 1 or in an analogous enclosure.

The feature that the power requirements of components forming part of a production unit and being operatively connected with the cooling system 5 at least equal 50 percent but can be as high as two-thirds of the overall power requirements of the respective unit has been found to be desirable and advantageous because this ensures highly satisfactory evacuation of heat and contributes significantly to more economical operation of the plant.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A plant for making commodities of the tobacco processing industry, comprising at least one enclosure; means for conditioning said at least one enclosure; at least one heat generating production unit in said at least one enclosure; and means for cooling said at least one unit, said cooling means having a portion located outside of said at least one enclosure and comprising a supply of liquid coolant and means for conveying the coolant along at least one predetermined path having at least one first section at said at least one unit and a second section within said portion of said cooling means.

2. The plant of claim 1, wherein said portion of said cooling means comprises means for exchanging heat with the coolant in the second section of said at least one path.

3. The plant of claim 2, wherein said heat exchanging means includes means for withdrawing heat from the coolant.

4. The plant of claim 2, wherein said at least one path is an endless path.

5. The plant of claim 2, wherein said at least one unit comprises a plurality of components including at least one heat generating component, said at least one first section of said at least one path being at least close to said at least one component so that the coolant which is being conveyed in said at least one first section of said at least one path can withdraw heat generated by said at least one component.

6. The plant of claim 1, comprising a plurality of heat generating production units in said at least one enclosure, said predetermined path having a plurality of first sections each at least closely adjacent to a different unit so that the coolant which is conveyed in said first sections can withdraw heat from the respective units.

7. The plant of claim 6, wherein said path is an endless path.

8. The plant of claim 1, wherein the liquid coolant includes water.

9. The plant of claim 1, wherein said at least one unit has a predetermined power requirement and comprises a plurality of components including at least one heat generating component having a power requirement constituting at least 50 percent of said predetermined power requirement, said at least one first section being at least close to said at least one heat generating component.

10. The plant of claim 9, wherein the power requirement of said at least one heat generating component at least approximates two thirds of said predetermined power requirement.

11. The plant of claim 1, wherein said at least one unit includes an at least substantially sealed chamber and said cooling means includes means for maintaining the temperature in said chamber within a selected range.

12. The plant of claim 1, wherein said at least one unit comprises at least one transmission and a supply of lubricant for the transmission, said cooling means including means for maintaining the supply of lubricant within a selected temperature range.

13. The plant of claim 1, wherein said at least one unit comprises an air blower having a conduit for compressed air, said conduit forming part of said cooling means.

14. The plant of claim 1, wherein said at least one unit comprises means for producing at least one rod of fibrous material and heat generating means for draping the at least one rod into a wrapper, said cooling means including means for withdrawing heat from said draping means.

15. The plant of claim 1, wherein said at least one unit comprises at least one motor having a heatable housing and said cooling means includes means for withdrawing heat from said housing.

16. The plant of claim 1, wherein said at least one unit comprises at least one conveyor and a heatable casing for said at least one conveyor, said cooling means including means for withdrawing heat from said casing.

* * * * *